US005108305A

United States Patent [19]

Suzuki

[11] Patent Number: 5,108,305

[45] Date of Patent: Apr. 28, 1992

[54] DEVICE FOR DETECTING ERRONEOUS INSERTION OF INSULATION DISPLACEMENT TERMINAL

[75] Inventor: Tetsuaki Suzuki, Shizuoka, Japan

[73] Assignee: Yazaki Corporation, Tokyo, Japan

[21] Appl. No.: 562,511

[22] Filed: Aug. 3, 1990

[30] Foreign Application Priority Data

Aug. 3, 1989 [JP] Japan ..... 1-200275

[51] Int. Cl.[5] ..... H01R 3/00

[52] U.S. Cl. ..... 439/488; 439/404; 324/538; 29/881; 29/884

[58] Field of Search ..... 439/395-399, 439/488-490, 924, 677, 679; 29/854, 881, 884, 882, 720, 721, 749; 324/66, 538; 340/687

[56] References Cited

U.S. PATENT DOCUMENTS 4,781,619 11/1988 Ikeda ..... 439/488

4,849,743 7/1989 Ohno ..... 439/490

4,902,244 2/1990 Endo et al. ..... 439/489

FOREIGN PATENT DOCUMENTS 3601115 7/1987 Fed. Rep. of Germany ..... 439/679

60-138266 9/1985 Japan .

*Primary Examiner*—Larry I. Schwartz

*Assistant Examiner*—Kevin J. Carroll

*Attorney, Agent, or Firm*—Sughrue, Mion, Zinn Macpeak & Seas

[57] ABSTRACT

Erroneous insertion of a press-connecting terminal is detected, either electrically or mechanically, by providing a piece either on a rear portion of a base plate of an electrical connector, or on a wire-press connecting portion disposed behind an electric contact portion which is provided at a front end of the base plate. The erroneous insertion-detecting piece is formed in accordance with a size of the press-connecting terminal.

1 Claim, 3 Drawing Sheets

DEVICE FOR DETECTING ERRONEOUS INSERTION OF INSULATION DISPLACEMENT TERMINAL

BACKGROUND OF THE INVENTION

This invention relates to an insulation displacement terminal (hereinafter press-connecting terminal) of a press-connecting connector, and also to a device for detecting an erroneous insertion of the press-connecting terminal into a connector housing.

Generally, a press-connecting connector has press-connecting terminals of different sizes received in a common connecter housing in juxtaposed relation. FIGS. 5 and 6 show a conventional press-connecting terminal and a conventional press-connecting connector, respectively, as disclosed in Japanese Laid-Open (Kokai) Utility Model Application No. 138266/85.

The press-connecting terminal A includes a base plate 1 which has at its front end portion an electric contact portion 2 for contact with a mating terminal. The base plate 1 has an electric wire-press connecting portion 3 disposed rearwardly of the electric contact portion 2, the electric wire-press connecting portion 3 having a pair of slots 3*a* and 3*b*. An upstanding tension-absorbing plate 5 is formed on the rear end of the base plate 1 for absorbing the tension of an electric wire W press-connected to the electric wirepress connecting portion 3. An electric wire-clamping portion 4 includes insulator-holding pieces 4*a* and 4*b* which are pressed for deformation.

The press-connecting terminals A are inserted respectively into terminal insertion chambers 7 of a connector housing B, as shown in FIG. 6, the rear upper wall of each terminal insertion chamber 7 being open. Then, each of the electric wires W is press-fitted in the slots 3*a* and 3*b* of the electric wire-press connecting portion 3 of the corresponding press-connecting terminal A, using a press-connecting jig. Then, a cover C is attached to the connector housing B, and they are locked or fixed relative to each other by means of locking plates 8 and locking pawls 9.

When the connector housing B is adapted to receive different sizes of press-connecting terminals for connection respectively with the various electric wires, unless each member of the electric wire/terminal pair corresponds to each other in size, the press-connection of the electric wire to the press-connecting terminal cannot be satisfactorily achieved electrically or physically. Therefore, it is necessary to confirm and inspect whether or not each terminal has been inserted erroneously into the housing.

However, the conventional press-connecting terminals A hardly differ in size from each other from their appearance, as shown in FIG. 5. The only differences are the width of the electrical contact portion 2 and the width of the slots 3*a* and 3*b*. Thus, no special mechanism is provided for discriminating the terminal size. Therefore, once the terminals are inserted into the housing, it is difficult to discriminate the size, and it has been impossible to check beforehand whether or not a proper size of terminal is inserted properly into the corresponding terminal insertion chamber 7.

SUMMARY OF THE INVENTION

With the above problem in view, it is an object of this invention to provide a press-connecting terminal whose size can be detected from the exterior either electrically or mechanically, and also to provide a device for detecting an erroneous insertion of such a terminal into a connector housing.

According to one aspect of the invention, there is provided a press-connecting terminal which includes a base plate having at its front end portion an electric contact portion for contacting a mating terminal, and an electric wire-press connecting portion disposed rearwardly of the electric contact portion, wherein an erroneous insertion-detecting piece, which can be detected electrically or mechanically, is provided on either the electric wire-press connecting portion or a rear end of said base plate, said erroneous insertion-detecting piece being formed in accordance with the size of said press-connecting terminal.

According to another aspect of the invention, there is provided a device for detecting an erroneous insertion of a press-connecting terminal into a housing, including a connector housing having a plurality of juxtaposed terminal insertion chambers, side walls of the terminal insertion chambers at their rear portions being open; a plurality of press-connecting terminals for respective insertion into said plurality of terminal insertion chambers; and an inspecting jig for detecting an erroneous insertion of each said press-connecting terminal; the plurality of press-connecting terminals having respective insertion-detecting pieces whose heights or shapes are different and are determined respectively in accordance with the sizes of electric wires to be press-connected respectively to said press-connecting terminals; the inspecting jig having an insulative holder disposed in opposed relation to the open portions of said terminal insertion chambers so as to move toward and away from said open portions; the insulative holder having members for detecting the heights or shapes of said erroneous insertion-detecting pieces; the detecting members being adjusted beforehand respectively in accordance with the sizes of said press-connecting terminals to be inserted respectively into said terminal insertion chambers; the inspecting jig being moved to a predetermined position close to said open portions of said terminal insertion chambers, thereby determining whether or not any erroneous insertion takes place.

The inventive press-connecting terminals have the respective erroneous insertion-detecting pieces whose heights or shapes are different and are determined respectively in accordance with the sizes of the terminals, that is, in accordance with the diameters of the electric wires to be press-connected respectively to the terminals.

Therefore, after these press-connecting terminals are inserted respectively into the terminal insertion chambers of the connector housing, the inspecting jig is used, before each electric wire is press-connected to the corresponding terminal, so as to check beforehand whether the press-connecting terminal of a proper size is inserted in a predetermined position, thereby preventing the production of the products having an imperfect press-connection.

DETAILED DESCRIPTION OF THE PREFERRED EMBODIMENT

Figure 1A:
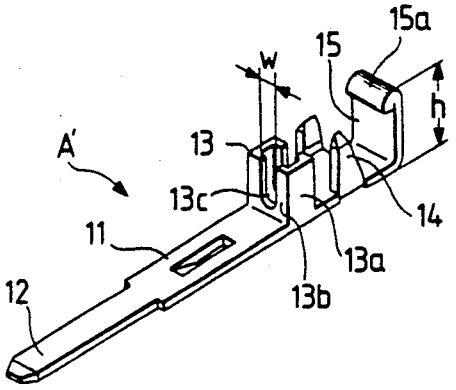
FIGS. 1(*a*) and 1(*b*) are perspective views of press-connecting terminals according to the invention.
Figure 1B:
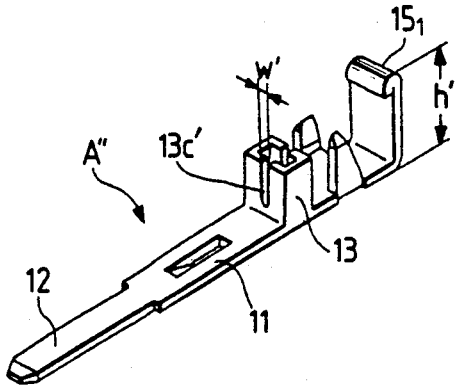

In FIGS. 1(*a*) and 1(*b*), the press-connecting terminals $A_1$ and $A_2$ have the same basic construction. The terminal $A_1$ includes a base plate 11 which has at its front end portion a tab-like electric contact portion 12, an electric wire-press connecting portion 13 and an electric wire-clamping portion 14 which are disposed rearwardly of the electric contact portion 12, and a tension absorbing plate 15 at the rear end of the base plate 11.

The electric wire-press connecting portion 13 has a pair of slots 13*c* formed respectively in opposed front and rear walls 13*b* of a frame-like portion 13*a* formed integrally on the base plate 11 in an upstanding manner.

The tension absorbing plate 15 also serves as an erroneous insertion-detecting piece for the terminal $A_1$, as will be described later. The tension absorbing plate 15 of the terminal $A_1$ will hereinafter be referred to as "erroneous insertion-detecting piece $15_1$".

The differences between the press-connecting terminals $A_1$ and $A_2$ are that the former is for an electric wire of a greater diameter whereas the latter is for an electric wire of a smaller diameter, and that the widths w and w' of the slots 13*c* and 13*c*' of the electric wire-press connecting portions 13 of the two terminals are determined according to the respective wire sizes such that $w > w'$.

Figure 7:
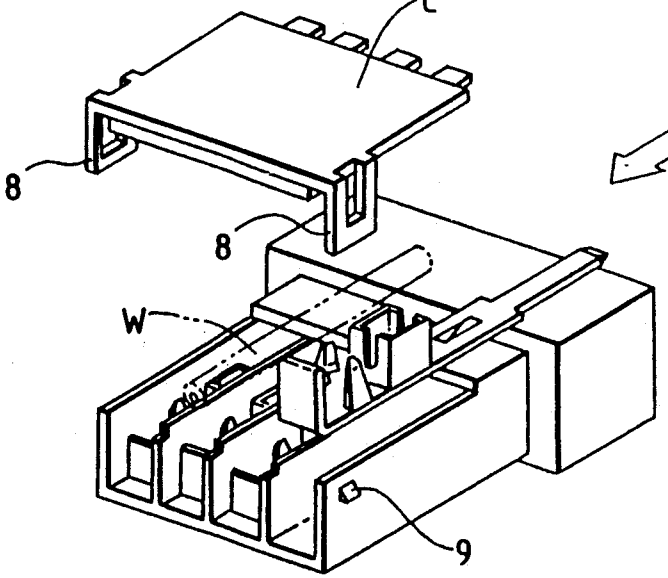
FIG. 7 PRIOR ART
FIG. 7 is a fragmentary cross-sectional view, showing the manner of clamping of an electric wire press-connected to the press-connecting terminal of FIG. 5.
Figure 7:
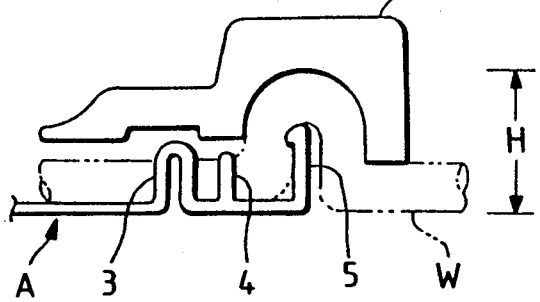
FIG. 7 PRIOR ART

In accordance with the respective slot widths, the heights h and h' of the erroneous insertion-detecting pieces $15_1$ and $15_2$ of the two terminals $A_1$ and $A_2$ are determined such that $h < h'$. FIG. 7 shows the conventional structure in which a wire W is held between a cover C and a tension absorbing plate 5. With respect to the above height difference, the detecting piece for the greater-diameter wire has a smaller height whereas the detecting piece for the smaller-diameter wire has a greater height, so that when the greater-diameter wire and the smaller-diameter wire are held in the above manner, the holding heights H for these wires are substantially equal to each other.

Figure 2:
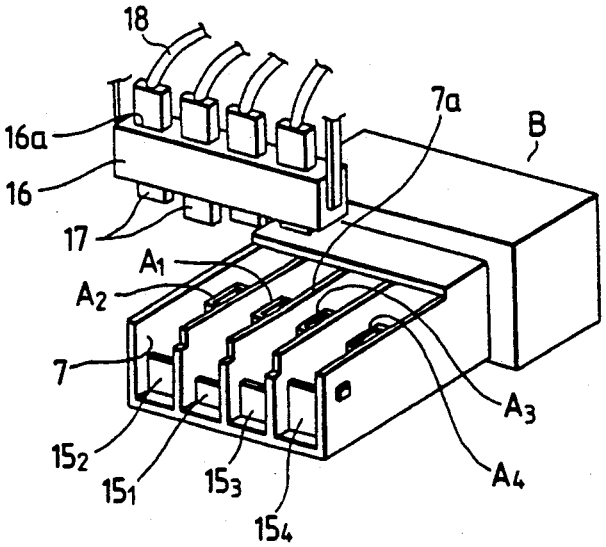
FIG. 2 is a perspective view, showing the manner of setting an insertion-inspecting jig on a housing having the press-connecting terminals attached thereto.

In FIG. 2, the connector housing B has four terminal insertion chambers 7 into which four press-connecting terminals $A_2$, $A_1$, $A_3$ and $A_4$, arranged in this order from the left in the drawings, are inserted, respectively. The relationship of the heights of the erroneous insertion-detecting pieces is $15_4 > 15_3 > 15_2 > 15_1$.

The erroneous insertion-inspecting jig D is constituted by a rectangular parallelepiped-shaped insulative holder 16 having insertion holes 16*a* into which a plurality of electrically-conductive plates 17 are removably inserted, respectively. The projecting lengths L of the electrically-conductive plates 17 from the lower surface of the insulative holder 16 are adjusted respectively in accordance with the height differences of the erroneous insertion-detecting pieces $15_1$ to $15_4$ of the press-connecting terminals $A_1$ to $A_4$.

Figure 3:
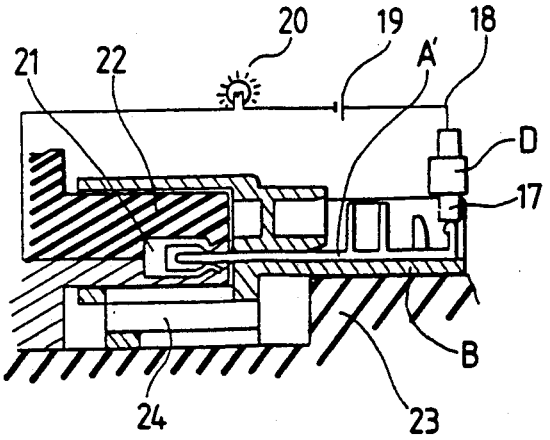
FIG. 3 is a cross-sectional view of an important portion of such a set condition.

As shown in FIG. 3, a power source 19 and a display lamp 20 are connected intermediate opposite ends of each lead wire 18, that wire being connected at one end to a respective one of the electrically-conductive plates 17. A clip-like electrical contact portion 21 connectable to the corresponding electric contact portion 12 of the press-connecting terminal is connected to the other end of the lead wire 18. A group of electrical contact portions 21 are received in a housing 22. In FIG. 3, reference numeral 23 denotes an inspection bed for the press-connecting connector, and reference numeral 24 denotes a connector seat.

A method of inspecting an erroneous insertion of the press-connecting terminal will now be described.

As shown in FIG. 2, the inspecting jig D is caused to descend mechanically relative to the connector housing B receiving the variously-sized press-connecting terminals $A_1$ to $A_4$.

The inspecting jig D descends to a predetermined position, for example, where the lower surface of the insulative holder 16 is disposed close to partition walls 7*a* of the terminal insertion chambers 7. In this condition, if the press-connecting terminals of proper sizes have been inserted properly in the respective predetermined positions, for example, the insertion inspecting pieces $15_2$, $15_1$ and $15_4$ are in contact with the corresponding electrically-conductive plates 17, so that the corresponding display lamps 20 are lit through electrical conducting. Thus, it is confirmed that the correctly-sized press-connecting terminals have been inserted.

Figure 4:
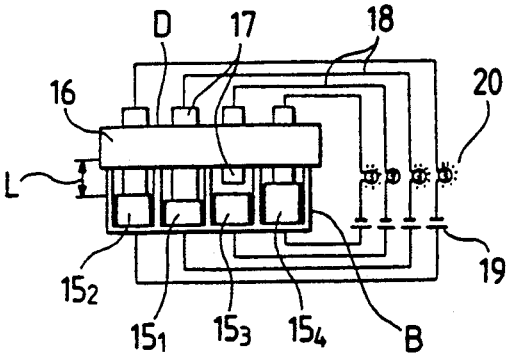
FIG. 4 is a view showing one example of an erroneous insertion-inspecting circuit.
Figure 5:
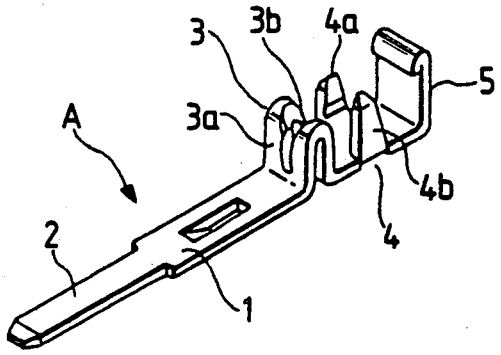
FIG. 5 PRIOR ART
FIG. 5 is a perspective view of a conventional press-connecting terminal.
Figure 6:
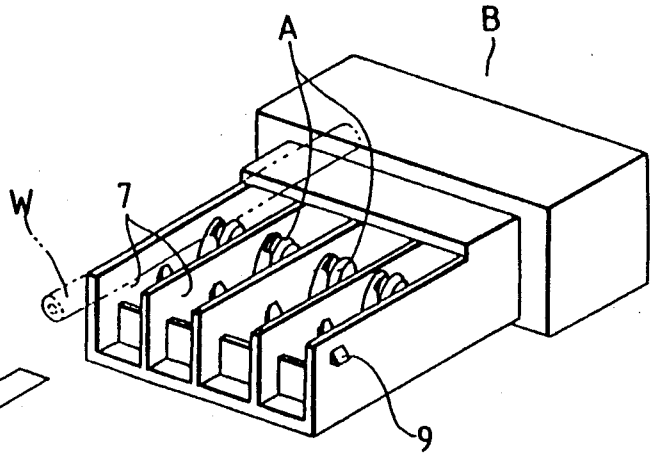
FIG. 6 PRIOR ART
FIG. 6 is a perspective view, showing a connector housing having the press-connecting terminals of FIG. 5 inserted thereinto, and a cover for the housing.

Also, for example, as shown in FIG. 4, if the press-connecting terminal $A_3$ having the erroneous insertion-detecting piece $15_3$ having an erroneous size (i.e., a smaller height than the proper height) has been inserted erroneously, the detecting piece $15_3$ is not in contact with the electrically-conductive plate 17. Therefore, the display lamp 20 is not lit, thus determining an erroneous insertion.

In contrast, if the press-connecting terminal having the erroneous insertion-detecting piece of a height greater than the proper height has been inserted, the inspecting jig D does not descend to the above predetermined position, so that the other terminals are not electrically conductive, thus detecting the erroneous insertion.

In the above embodiment, although the tension absorbing plate 15 also serves as the erroneous insertion-detecting piece, the erroneous insertion-detecting piece may be defined by the electric wire-press connecting portion 13 or the electric wire-clamping portion 14. Alternatively, erroneous insertion-detecting pieces of different heights, separate from these portions, may be formed upstandingly on the respective base plates 11 at a region except for the electric contact portion 12. Further, instead of the electrical-conducting detecting method in which the erroneous insertion-detecting pieces $15_1$ to $15_4$ are contacted with the respective electrically-conductive plates 17, a photo-sensing method may be used, in which light-emitting elements and light-receiving elements are provided on the erroneous insertion-inspecting jig D. As a result, for example, the time and amount of reflection of light by each erroneous insertion-detecting piece is compared with a reference value, thereby detecting the erroneous insertion. In the case of such a photo-sensing method, for example, a bent free end 15*a* of the tension absorbing plate 15 shown in FIG. 1(*a*) may be changed in bending length or bending angle so that the shape of the erroneous insertion-detecting piece of the press-connecting terminal can meet the size of the terminal.

As described above, the inventive press-connecting terminal has an erroneous insertion-detecting piece determined in accordance with the size of the electric wire to be connected to this terminal. Therefore, before the electric wire is press-connected to the terminal after the terminal is inserted into the connector housing, the erroneous insertion can be detected electrically or mechanically, thereby preventing the production of imperfect products.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. A device for detecting an erroneous insertion of an insulation displacement terminal into a housing, comprising:

a connector housing having a plurality of juxtaposed terminal insertion chambers, side walls of said terminal insertion chambers being open at rear portions thereof;

a plurality of insulation displacement terminals to be inserted respectively into said plurality of terminal insertion chambers, said plurality of insulation displacement terminals having respective insertion-detecting pieces whose heights or shapes are different and are determined respectively in accordance with the sizes of electric wires to be connected respectively to said insulation displacement terminals; and an inspecting jig for detecting an erroneous insertion of each of said insulation displacement terminals, said inspecting jig having an insulative holder disposed in opposed relation to the open portions of said terminal insertion chambers so as to move toward and away from said open portions, said insulative holder having detecting members for detecting the heights or shapes of said erroneous insertion-detecting pieces, said detecting members being adjusted beforehand respectively in accordance with the sizes of said insulation displacement terminals to be inserted respectively into said terminal insertion chambers;

said inspecting jig being moved to a predetermined position into said open portions of said terminal insertion chambers, thereby determining whether or not any erroneous insertion takes place.

* * * * *